United States Patent [19]

Gingerich et al.

[11] 4,218,240

[45] Aug. 19, 1980

[54] METHOD FOR PRODUCING COBALTIC HEXAMMINE COMPOUNDS AND COBALT METAL POWDER

[75] Inventors: Richard G. W. Gingerich, Towanda; Robert P. McClintic, Monroeton, both of Pa.

[73] Assignee: GTE Products Corporation, Stamford, Conn.

[21] Appl. No.: 38,970

[22] Filed: May 14, 1979

[51] Int. Cl.[2] ..... C22B 23/04

[52] U.S. Cl. ..... 75/0.5 AA; 75/119; 423/143

[58] Field of Search ..... 75/0.5 AA, 119; 423/143

[56] References Cited

U.S. PATENT DOCUMENTS

| | | | |
|---|---|---|---|
| 2,826,499 | 3/1958 | Schlecht et al. | 75/119 X |
| 2,879,137 | 3/1959 | Bare et al. | 75/119 X |
| 3,928,530 | 12/1975 | Bakker et al. | 75/119 X |
| 3,933,976 | 1/1976 | Nikolic et al. | 423/144 |
| 4,093,450 | 6/1978 | Doyle et al. | 75/0.5 AA |
| 4,108,640 | 8/1978 | Wallace et al. | 75/0.5 AA |

FOREIGN PATENT DOCUMENTS 1583864 2/1924 Fed. Rep. of Germany .

*Primary Examiner*—G. Ozaki
*Attorney, Agent, or Firm*—Robert E. Walter

[57] ABSTRACT

Cobalt is recovered by treating aqueous solutions containing ammonia and cobalt ions with a sufficient amount of an acid in the presence of a catalyst to convert the cobalt ions to a cobalt hexammine ion which is precipitated and separated from the resulting solution. According to another aspect of the invention, a cobalt compound is precipitated from an aqueous solution of cobaltic hexammine halide by treating the solution with a metallic hydroxide and the precipitate is subsequently reduced to form fine cobalt powder.

14 Claims, No Drawings

METHOD FOR PRODUCING COBALTIC HEXAMMINE COMPOUNDS AND COBALT METAL POWDER

CROSS REFERENCE TO RELATED APPLICATIONS

The co-pending applications relating to the production of fine metal cobalt filed concurrently herewith include Ser. No. 038,973 relating to mother liquor treatment, Ser. No. 038,968 utilizing an ion exchange resin during cobalt liquor processing, Ser. No. 038,972 including an ammonia recycling step, and Ser. No. 038,971 relating to the use of a metallic hydroxide to form a cobalt containing precipitate.

TECHNICAL FIELD

This invention relates to the production of cobaltic hexamine compounds and fine metallic cobalt powder produced therefrom, and more particularly to a process for converting cobalt ions to a cobaltic hexammine halide relatively free of impurities and a further process for producing fine cobalt powder from said cobaltic hexammine halide.

Fine cobalt powder of high purity is typically used in the manufacture of cemented carbide cutting tools, magnetic tapes, and magnetic inks.

BACKGROUND OF THE INVENTION

The following patents are directed to the separation of cobalt from other cations, especially nickel. The resulting cobalt compounds are not disclosed as being sources for forming fine particle size cobalt.

U.S. Pat. No. 2,879,137 to Bare et al. discloses an ammoniacal ammonium carbonate solution obtained from leaching an ore and containing nickel and cobalt in the cobaltic state which is treated with an alkali metal or alkaline earth metal hydroxide under controlled temperature conditions to precipitate the nickel free of cobalt.

U.S. Pat. No. 3,928,530 to Bakker et al. discloses a process for the separation of nickel and cobalt by forming pentammine chloride complexes in solution containing a high concentration of ammonium chloride, and precipitating cobalt pentammine chloride.

In German Pat. No. 1,583,864, cobalt is recovered from scrap by digestion of the scrap in HCl and $MgCl_2$ solution, followed by removal of iron and chromium impurities by precipitation at a moderately acid pH followed by extracting a cobalt chloride complex with a long chain tertiary amine in an aromatic solvent.

U.S. Pat. No. 4,108,640 to Wallace discloses a process for recovering metallic cobalt from an aqueous ammoniacal solution wherein the solution is contacted with a water immiscible liquid ion exchange reagent dissolved in an inert organic diluent to selectively extract the other metal from the solution and produce an organic extract loaded with the other metals and an aqueous cobalt bearing raffinate substantially free of the other metals.

Cobalt metal powder is produced according to one prior at process as disclosed in West German Pat. No. 2,319,703. Cobalt is separated from nickel by a process which includes forming pentammine sulfate complexes of the two ions in solution. It has been found that soluble cobalt ammine sulfates can only be reduced while still in solution, under pressure and with the aid of catalyst. Furthermore, the resulting cobalt powder is not of fine particle size.

U.S. Pat. No. 4,093,450 to Doyle et al. describes a process for producing fine particle size cobalt metal powder by the hydrogen reduction of cobalt oxide obtained from a cobalt pentammine carbonate solution. The precipitate was formed by heating the solution to drive off ammonia and carbon dioxide to form a precipitate of cobalt oxide. This process requires a solution of approximately four grams per liter of cobalt to produce a metal powder having a particle size less than one micron. Note that the final resulting particle size is highly dependent on the concentration of cobalt employed in the aqueous solution.

SUMMARY OF THE INVENTION

It is an object of the present invention to provide a new process for forming a relatively pure cobaltic hexammine halide.

A further object is to substantially completely precipitate the cobaltic hexammine halide from an aqueous solution.

A further object is to substantially completely convert cobaltic ions in an aqueous solution to cobaltic hexammine ions.

A further object is to provide a new process for forming very fine metallic cobalt particles.

A further object is to effectively form fine cobalt powder substantially independent of the concentration of cobalt in the initial solution.

Other and further objects of the present invention will become apparent from the following description.

In accordance with the present invention, there is provided a process for recovering a cobaltic hexammine halide from an aqueous solution containing cobalt ions and ion impurities comprising complexing said cobalt ions with ammonia in the presence of a catalyst to form cobaltic hexammine ions, treating said solution with an acid in the presence of halide ions to form a cobaltic hexammine halide precipitate, and removing said precipitate from said solution containing ion impurities.

Also, in accordance with the present invention, said purified cobaltic hexammine halide is dissolved in water and the resulting solution is treated with a metallic hydroxide to form a cobalt containing precipitate. The cobalt containing precipitate is reduced to form fine cobalt metal powder.

DETAILED DESCRIPTION

Aqueous solutions containing cobalt from a variety of sources may be utilized in the method of the present invention. Such solutions may be derived from sludges and leach solutions from cemented carbide or tungsten recovery operations which may result from the digestion of scrap and impure powders. Typical leach solutions are obtained from leached oxidic materials, such as ores, oxidized sulfite concentrates, hydroxide concentrates, and the like. These starting solutions may contain a variety of anions and cations such as iron, manganese, copper, aluminum, chromium, magnesium, nickel, calcium, sodium, potassium, etc.

It is contemplated that the cobalt ion containing starting solution may be formed from a byproduct stream from various hydrometallurgical processes. U.S. Pat. No. 3,933,975 to Nikolic describes a hydrometallurgical process wherein a nickel-ammonium sulfite precipitate is separated from a solution containing cobaltic ions and the resulting solution is passed through an ion exchange column to selectively remove nickel. The resulting solution contains cobalt ions.

To convert the cobalt ions to a cobaltic hexammine ions, the cobalt ions are complexed with ammonia in the presence of a catalyst. Ammonia is preferably present in at least a stoichiometric amount to result in the substantially complete conversion of the cobalt ions to the cobaltic hexammine complex ion. The molar concentration of ammonia present in solution is preferably in excess of six times the molar concentration of cobalt ions present. It is contemplated that the ammonia containing solution may be formed in a variety of ways such as bubbling ammonia gas there through or adding ammonium hydroxide directly to the solution.

It is desirable to oxidize cobalt ions present in the divalent state in the starting solution to the trivalent state. Conventional oxidation methods may be utilized. The solution containing cobalt ions and ammonia may be contacted with a gas containing oxygen such as by aeration for a sufficient period of time to substantially convert the cobalt ions to the trivalent state. Other oxidizing methods known such as adding sodium hypochlorite may be used.

In accordance with the process of the present invention to obtain the preferential conversion of the cobalt ion to the cobaltic hexammine complex ion a catalyst is present. The amount of catalyst present does not appear critical except to the extent that the use of an exceeding small amount of catalyst requires greater agitation and longer reaction times. It has been found that palladium and carbon compounds such as activated charcoal and graphite may be used as catalyst. The exact theoretical operation of the catalyst is not understood but it is believed that various substances present in the carbon act to catalyze the reaction. Catalyst which are insoluble in the aqueous solution containing cobalt are preferably added as particulate and intimately mixed therewith. To have a reasonably rapid rate of reaction, it is preferably to have from about 10 to about 50 percent catalyst present in the solution based on the weight percent of cobalt present in the solution.

To form the cobaltic hexammine complex ion in accordance with the present invention, it is necessary to have ammonia and catalyst present in solution to result in the substantially complete conversion of the cobalt ions. The order of addition or formation of reactants as may be the case where the cobalt ions or ammonia is formed in situ is generally not critical.

According to one process, a cobalt source containing various impurities is digested in a hydrochloric acid solution to obtain a solution of about 40 to 150 grams per liter of cobalt in one to about six molar hydrochloric acid. The cobalt ion containing solution is added to a solution of ammonium hydroxide at a concentration of 100 to 150 grams per liter. About 10 grams of activated carbon is added and the resulting mixture is air oxidized while being stirred. The pH of the resulting solution varied between about 9 and 12. Since the presence of ammonia results in the formation of a buffered system, the pH is adjusted to the lower pH value, i.e. about 9, if the original solution containing digested cobalt source contains hydrochloric acid at a high concentration, i.e. about 6 M. If the original solution contains a low concentration of hydrochloric acid, i.e. about 0.1 M, the resulting adjusted pH was a high value, i.e. about 12. The above process results in the substantially complete conversion of the cobalt in the solution to the cobaltic hexammine complex ion. Typically greater than about 99 percent of the cobaltous ions are converted to the cobaltic hexammine complex ions with the remaining less than about one percent converted to other species such as cobaltic pentammine or remaining as cobaltous ions. In this case, the conversion generally does not appear to depend on temperature since varying the temperature over a wide range, i.e. 30° C. to about 60° C., had little effect on the rate of reaction. In certain cases, it has been found desirable to add the cobalt ion solution to the ammonia solution and oxidize at temperatures less than about 20° C. It is speculated that unknown undesirable side reactions are avoided.

The solution containing cobaltic hexammine complex ion together with ions of impurities is acidified in the presence of halide ions to form a cobaltic hexammine halide precipitate. A sufficient amount of an acid is preferably added to result in a pH less than about 0. The acid used is preferably a hydrogen halide of the formula HX wherein X is fluorine, chlorine, bromine, or iodine. The resulting cobaltic hexammine halide precipitate has the chemical formula $Co(NH_3)_6X_3$ wherein X is as before described.

When the acid utilized is hydrochloric acid, it has been found that the solubility of cobalt hexammine chloride of the formula $Co(NH_3)_6Cl_3$ has a solubility which decreases with increasing concentration of the chloride ion. In those cases where the initial cobalt source is digested with hydrochloric acid, the presence of chloride ion either from the digestion step or the acidification step is beneficial. Most preferably the pH of the resulting solution after acidification is below about 0. The size of the crystals obtained appears to be dependent on temperature and rate of addition of hydrochloric acid. To obtain crystals which are easily separated, it is desirable to maintain the temperature below about 80° C. with temperatures on the order of below about 10° C. being most preferred. Large crystals are preferentially formed with the slow addition of hydrochloric acid, preferably over a period of about 30 minutes to 2 hours.

The precipitated cobaltic hexammine halide may be separated from the remaining solution by conventional liquid-solid separation processes such as filtration. Acid soluble ion impurities, such as alkali metals, alkaline earth metals and some transition metals remain in the filtrate or remaining solution. When a catalyst in particulate form is utilized, it may be removed from the remaining solution at this step with the precipitated cobaltic hexammine halide. It is also contemplated that the catalyst may be removed from solution prior to precipitating the cobaltic hexammine halide by conventional liquid-solid separation processes as applied to the solution containing the cobalt hexammine complex ion in solution.

The precipitated cobalt hexammine halide which may or may not include catalyst mixed therewith is dissolved in water. The rate of dissolution is aided at temperatures greater than about 70° C. and by adjusting the pH of the solution to about 4 to about 8 by the addition of a base such as sodium hydroxide or ammonium hydroxide. Preferably the desired pH is selected or adjusted to result in the precipitation of the transition metals remaining in solution. The precipitated metals together with any particulate catalyst not separated previously is removed by conventional liquid-solid separation techniques. A solution containing cobaltic hexammine ions results which may be further purified by recrystallization by acidification in the presence of a halide ion and subsequent dissolution together with the filtration steps as above described.

Further, in accordance with the present invention, the resulting cobaltic hexammine halide in an aqueous solution relatively free of ion impurities, is treated with a sufficient amount of a soluble metallic hydroxide to form a cobalt containing precipitate. The purity of the resulting metallic cobalt is dependent on the purity of cobaltic hexammine solution in that certain metallic cations which may be regarded as impurities will precipitate with the cobalt and be present in the final reduced cobalt metallic powder. It is generally preferred that the cation impurities be present in the solution in an amount less than about 1 percent based on the weight percent of cobalt present in the solution.

The aqueous solution containing the substantially pure cobaltic hexammine complex is next treated with a sufficient amount of a soluble metallic hydroxide to form a cobalt containing precipitate. Preferably the metallic hydroxide utilized is an alkali metal hydroxide or alkaline metal hydroxide. Even more preferably, alkali metal hydroxides are used since they may be more easily removed from the precipitated product by washing. Sodium hydroxide and potassium hydroxide are even more preferably used due to their commercial availability. The metallic hydroxide may be used in any form resulting in its presence or formation in the solution. Metallic hydroxide in solid form and dissolved in aqueous solution have been utilized.

The metallic hydroxide is added in an amount sufficient to form a cobalt containing precipitate from the resulting solution. The desired cobalt containing precipitate generally forms after a sufficient amount of metal hydroxide has been added to give the solution a pH of from about 10 to about 12. The occurrence of a rapid change in the pH is indicative that sufficient metal hydroxide has been added. It has generally been found that a concentration of metallic hydroxide based on the hydroxide radical is used in a molar amount corresponding to at least three times the cobalt concentration of the solution is preferable.

The metallic hydroxide addition is preferably carried out at a temperature greater than about 50° C. and for a period of time greater than about 15 minutes. It has been discovered that more rapid additions carried out at lower temperatures result in an apparent slower reaction to give mixtures which settled and filtered slowly. Most preferably the metallic hydroxide is added over the period of from about 15 minutes to about 9 hours at a temperature from about 80° C. up to a temperature corresponding to the boiling point of the solution.

The precipitate formed preferably has a black coloration. It is believed to be an amorphous hydrated cobaltic compound. Although it is difficult to measure the particle size of the precipitate, it appears that particles are from about 10 to about 25 microns in size. Air drying the cobalt containing precipitate at a temperature at about 100° C. results in the formation of particles having a particle size from about 2 to about 5 microns. These particles appear to be a hydrated cobaltic oxide having the formula $Co_2O_3.1H_2O$.

Extra fine particle size cobalt, preferably having a particle size less than about 1.5 microns, is produced directly by the reduction of the cobalt containing precipitate which is formed. It is not necessary to air dry the precipitate prior to the reduction step. After separating the precipitate from solution, it is heated in a reducing atmosphere for a time and temperature sufficient to reduce the precipitate to a cobalt metal powder. Such a reduction is typically carried out in a hydrogen atmosphere for a time of about 1 to about 6 hours at a temperature from about 350° C. to 600° C.

The following examples will further illustrate the specific embodiments of this invention. It should be understood, however, that these examples are given by way of illustration and not limitation. All temperatures are in degrees C and all parts are by weight, unless otherwise indicated.

EXAMPLE 1

The following were added successively to a 2000 milliliter beaker that was equipped with a 2.5 inch magnetic stirring bar: 250 ml. of a 28 percent by weight aqueous ammonium hydroxide; 200 ml. of aqueous cobaltous chloride solution in 2.8 molar hydrochloric acid which contained 120 grams of cobalt per liter and 0.5 to 10 percent on a cobalt basis of iron, manganese, magnesium, aluminum, sodium, calcium, nickel, chromium, nickel, chromium, copper etc.; and 4.9 gm. of granular activated charcoal were successively added. The resultant mixture having a pH value of 9.7 was maintained at a temperature of 40° C. and stirred for 7 hours. Successively, the resulting suspension was treated with 250 ml. a 36 percent by weight aqueous hydrochloric acid solution, cooled to 3° C. in an ice bath and filtered on a funnel. A mixture of insoluble yellow hexamminecobalt(III) chloride and charcoal was obtained after a wash of 120 ml of 6 M hydrochloric acid had been applied to the solids in the funnel. Next, these solids were added to 500 ml. of hot water and the pH value of the resultant mixture was adjusted to 8.0 with sodium hydroxide. After heating the suspension to 90° C., it was filtered on a funnel to remove iron, aluminum and other precipitated ions. The filtrate containing 24g cobalt per liter was successively treated with 550 ml of a 36 percent by weight hydrochloric acid solution, cooled to 5° C. in an ice bath and filtered on a funnel. Washing the resultant insoluble hexamminecobalt (III) chloride with 100 ml. of 6M HC1 gave a 98% yield of extremely pure product. Based on cobalt, the impurities present on parts per million are: Ca<4.0; Cu<3.0; Mg<2.0; Mn 5.4; Ni<10; S:<43; Cr<8.0; and Fe<13.

EXAMPLE 2

An aqueous hexamminecobalt (III) chloride mixture was prepared in accordance with the procedure set forth in Example I. About 1.2 liters of the mixture which contained 15 grams of cobalt per liter was heated to 92° C. in a 2000 ml beaker with stirring. A total of 50 grams of sodium hydroxide was added as 280 pellets over a 3.5 hour period to the yellow orange cobalt solution. A black solid precipitate of cobalt oxide hydrate formed and was removed from the mother liquor and washed with water. Reduction of the black precipitate at 500° C. under a hydrogen atmosphere gave 17.7 grams (99% yield) of extra fine cobalt metal powder having a FSSS of 1.38.

EXAMPLE 3

Aqueous solutions containing hexamminecobalt (III) chloride were prepared at concentrations at 20, 30, 40 and 50 grams per liter based on cobalt concentration. Each of the solutions were treated with sodium hydroxide and the resulting precipitate reduced according to the procedure set forth in Example 2. The cobalt powders have Fisher Sub Sieve Sizes from about 1.3 to about 1.4.

Although the present invention has been described in conjunction with specific embodiments, it is to be understood that modifications and variations may be made therefrom without departing from the spirit and scope of the invention. Such modifications and variations are considered to be within the scope of the invention as described in the appended claims.

INDUSTRIAL APPLICABILITY

The method described and claimed herein is particularly useful in the formation of extra fine particle size cobalt powders of high purity, which is useful, for example, as a starting material in the formation of cemented carbides, e.g., tungsten carbide.

We claim:

1. A method for recovering a cobaltic hexammine halide from an aqueous solution containing cobalt ions and ion impurities comprising complexing said cobalt ions with ammonia in the presence of a catalyst to form cobaltic hexammine ions, treating said solution with an acid in the presence of halide ions to form a cobaltic hexammine halide precipitate, and removing said precipitate from said solution and ion impurities.

2. A method according to claim 1 wherein said cobalt ions comprise cobaltous ions and said complexing includes oxidizing the cobaltous ions to cobaltic ions.

3. A method according to claim 1 wherein said aqueous solution contains greater than about five percent by weight cobalt.

4. A method according to claim 3 wherein said aqueous solution contains ammonia in an amount in excess of six times the amount of cobaltic ions present.

5. A method according to claim 1 wherein said catalyst comprises activated carbon.

6. A method according to claim 1 wherein said solution is treated with acid to result in a pH of less than about 0, and said halide comprises chloride.

7. A method according to claim 1 wherein solution comprises acid soluble ion impurities after said cobaltic hexammine halide precipitate is removed therefrom.

8. A method according to claim 7 wherein said cobaltic hexammine halide precipitate includes particulate catalyst mixed therewith.

9. A method according to claim 7 wherein said cobaltic hexammine precipitate is dissolved in an aqueous solution.

10. A method according to claim 7 wherein the pH of said aqueous solution containing dissolved cobaltic hexammine is selected so as to result in the precipitation of ion impurities comprising transition metals.

11. A method according to claim 7 wherein said cobaltic hexammine halide precipitate dissolved in an aqueous solution is separated from impurities, said impurities being formed as a precipitate.

12. A method for producing fine particle size cobalt metal powder comprising complexing cobalt ions present in an aqueous solution with ammonia in the presence of a catalyst to form a cobaltic hexammine ion, treating said solution with an acid in the presence of halide ions to form a cobaltic hexammine halide precipitate, removing said precipitate from said solution and impurities, dissolving said precipitate in an aqueous solution to form a relatively pure solution thereof, treating said relatively pure solution with a sufficient amount of a metallic hydroxide to form a cobalt containing precipitate, and reducing said cobalt containing precipitate to form fine particles of cobalt.

13. A method according to claim 12 wherein said metallic hydroxide is added to said solution until said solution has a pH of from about 10 to about 12.

14. A method according to claim 13 wherein said cobalt containing precipitate comprises a black cobalt hydrate in amorphous form.

* * * * *